US005342262A

United States Patent [19]

Hansen

[11] Patent Number: 5,342,262

[45] Date of Patent: Aug. 30, 1994

[54] VERTICALLY-DISPOSED EXERCISE MACHINE

[76] Inventor: Mark D. Hansen, 1524 E. Hampton St., Tucson, Ariz. 85719

[21] Appl. No.: 122,003

[22] Filed: Sep. 13, 1993

[51] Int. Cl.[5] ..... A63B 21/00

[52] U.S. Cl. ..... 482/62; 482/51

[58] Field of Search ..... 482/62, 64, 51, 57, 482/72, 63, 114, 51, 52, 53; 128/25 R

[56] References Cited

U.S. PATENT DOCUMENTS

| | | | |
|---|---|---|---|
| 1,820,372 | 8/1931 | Blomquist . | |
| 3,309,084 | 3/1967 | Simmons . | |
| 4,693,468 | 9/1987 | Kurlytis et al. | 482/62 |
| 4,705,269 | 11/1987 | DeBoer et al. . | |
| 4,902,002 | 2/1990 | Huang . | |
| 5,016,870 | 5/1991 | Bulloch et al. | 482/62 |
| 5,044,627 | 9/1991 | Huang | 482/62 |

*Primary Examiner*—Stephen R. Crow
*Attorney, Agent, or Firm*—Schmeiser, Morelle & Watts

[57] ABSTRACT

The invention is a vertically-disposed exercise machine that is designed to accommodate a user who is in a standing position. The machine includes a lower crankset having pedals adapted to receive a user's feet. The machine has an height adjustable upper crankset that is independent from the lower crankset and includes outwardly-extending handles that are designed to be grasped by the user. Each crankset is operatively connected to its own flywheel by a chain or belt. Each flywheel has its own manually adjustable resistance mechanism that allows the user to independently adjust the resistance to rotation of each crankset. When operating the machine, a user can selectively cause the rotation of the upper and/or lower cranksets by appropriate movement of his hands and/or feet.

15 Claims, 3 Drawing Sheets

VERTICALLY-DISPOSED EXERCISE MACHINE

FIELD OF THE INVENTION

The invention is in the field of exercise equipment. More particularly, the invention is an exercise machine adapted for use by a person who is in a standing position. The machine includes an upper rotatable assembly and an independent lower rotatable assembly.

BACKGROUND OF THE INVENTION

Many different types of machines have been invented to enable a user to exercise in an efficient and effective manner. Of these, most are designed for use in a relatively small space by a user who is in a sitting or supine position.

One of the most common exercise machines is an exercycle. In this type of device, a person sits on a padded seat and uses his or her legs to rotate a pedal crank assembly. This will normally cause a chain-attached flywheel to also rotate. In most machines of this type, a manually-adjustable resistance is operatively connected to the flywheel so that a user can vary the degree of difficulty required to move the pedals.

Another common type of exercise machine is a combination unit that includes a plurality of exercise stations and/or is reconfigurable so that the apparatus may be used to exercise different sets of a user's muscles. However, combination units are not designed to allow a user who is in a standing position to comfortably exercise a full range of upper and lower body muscles.

One prior art device that should be noted is described in U.S. Pat. No. 1,820,372 issued to Blomquist in 1931. In the described device, a user stands on an inclined machine that includes upper and lower cranksets that are operatively interconnected. When a user rotates the upper crankset via the attached handles, the lower crankset and its attached pedals are caused to rotate and vice-versa. This device does not include two separate rotatable assemblies that would allow a user to independently operate and adjust the different portions of the machine to accommodate his or her needs or comfort.

SUMMARY OF THE INVENTION

The invention is an exercise machine in which two independent, vertically-spaced rotatable assemblies are adapted for operation by a user who is in a standing position. The assemblies are secured to an inclined frame that is attached to a height-adjustable base platform.

The uppermost assembly includes a crank-set having a pair of outwardly projecting handles for the user's hands. The assembly further includes a flywheel that is attached to the crankset by a chain and is thereby caused to rotate whenever a user rotates the crankset. In contact with the flywheel is a manually-adjustable resistance mechanism that enables a user to control the effort required to rotate the crankset.

The lower rotatable assembly is similar to the upper assembly in that it includes a crankset to which a flywheel is operatively connected by an endless chain. In the lower assembly, the crankset includes a pair of outwardly-extending pedals that are adapted to support and be moved by the user's feet. A variable resistance mechanism is connected to the flywheel and is manually adjustable by a user to control the difficulty required to rotate the crankset.

The machine's frame includes a telescopically-adjustable front section to which both cranksets are secured. A rear section of the frame supports the flywheels and their associated resistance mechanisms. The rear section of the frame is also adapted to enable a user to adjust the height of the flywheel and resistance mechanism of the uppermost rotatable assembly.

The invention allows a user to stand on and rotate the pedals while also rotating the crankset of the upper rotatable assembly. Each of the rotatable assemblies is fully independent of the other to thereby allow the user to individually adjust and/or operate either of the assemblies. The device further allows the user to adjust the vertical spacing between the two assemblies to thereby adapt the machine to his or her height or other body dimensions.

To further accommodate the body dimensions of a user, unique adaptors for the attachment of the handles to the upper crankset are disclosed. The adaptors change the horizontal spacing between the handles and may also be used to alter the diameter of the circular path traveled by the handles. Improved pedal members are also disclosed that function to enhance the support the invention provides for the user's feet.

DETAILED DESCRIPTION OF THE DRAWINGS

Figure 1:
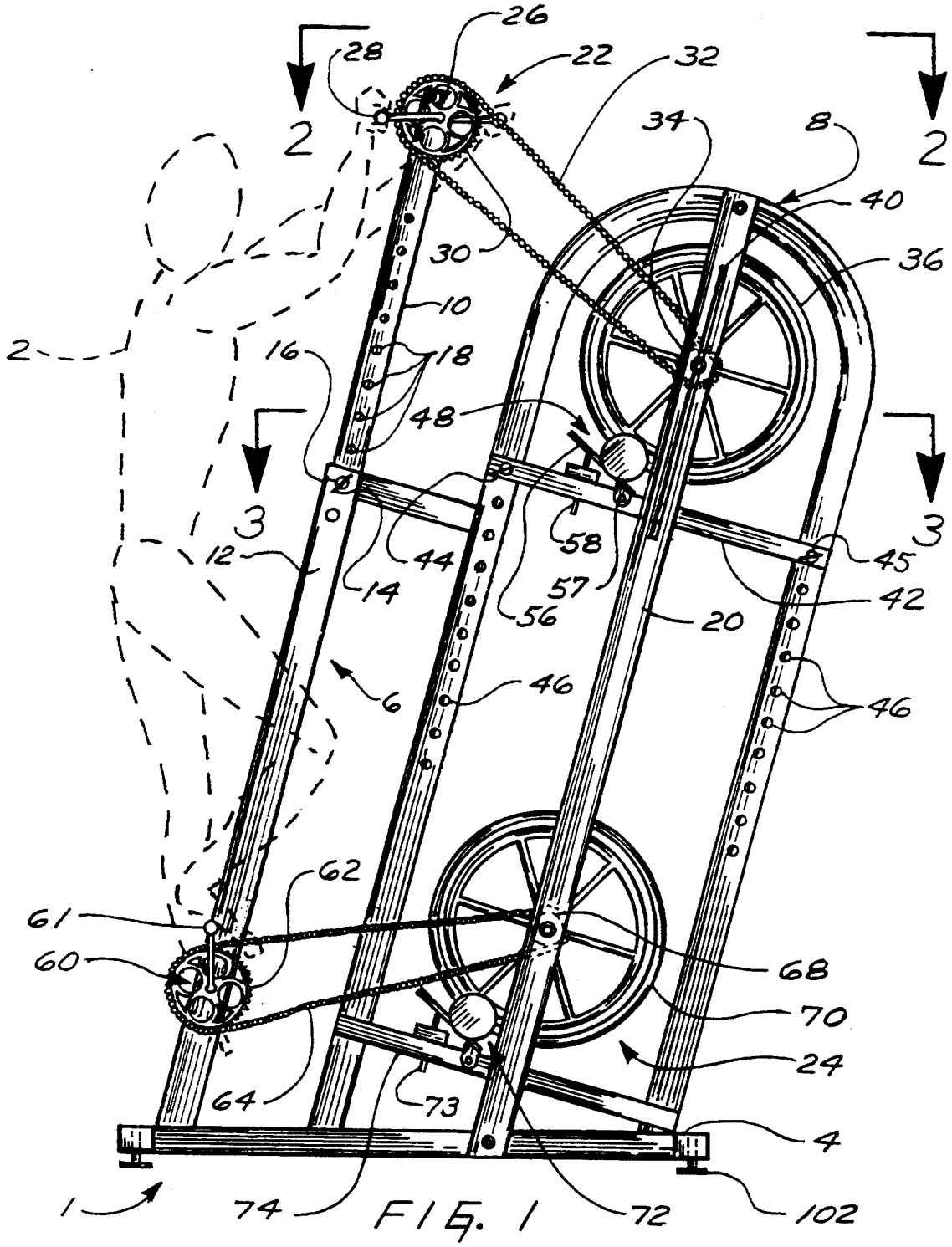
FIG. 1 is a side view of the invention with a user shown in phantom.

Referring now to the drawings in greater detail, wherein like reference characters refer to like parts throughout the several figures, there is shown by the numeral 1 an exercise machine in accordance with the invention.

FIG. 1 presents a side view of the machine and also shows a user 2 in phantom. The machine includes a base 4 that has an attached vertically-extending front frame portion 6 and a arcuately-shaped rear frame portion 8.

The front frame portion 6 includes an upper section 10 that is telescopically received within a lower section 12. A movable locking pin 14 is fitted through an aperture 16 in the lower section and is received within any of the apertures 18 of the upper section to adjustably secure together the two sections.

The rear portion 8 of the frame is in the form of an inclined, arcuately-shaped member. Two vertically-extending support members 20 are located on the right and left sides of the frame portion and are attached to the base at their bottom ends and to the apex of portion 8 at their top ends.

Secured to the base and frame portions are an upper rotatable assembly 22 and a lower rotatable assembly 24. The two rotatable assemblies are operatively independent of each other. As shown, the upper assembly is designed to be operated by a user's hands and the lower assembly is adapted to receive and be operated by the user's feet.

The upper rotatable assembly 22 comprises a rotatable crankset 26 (consisting of the two cranks and the crankshaft that connects them) that has an attached pair of outwardly-extending handle members 28. The handle members are made of a rigid material and are each shaped to enable comfortable grasping by a user's hand. The crankset is mounted on the upper section 10 of the front frame portion 6. Secured to and rotatable with the crankshaft of the crankset is a gear 30.

Figure 2:
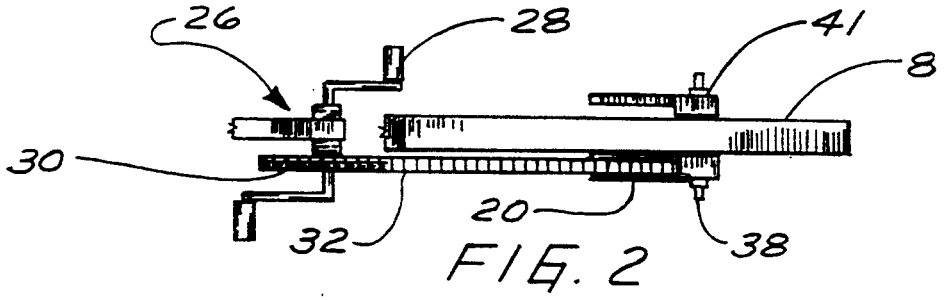
FIG. 2 is a plan view of the top portion only of the invention shown in FIG. 1.
Figure 3:
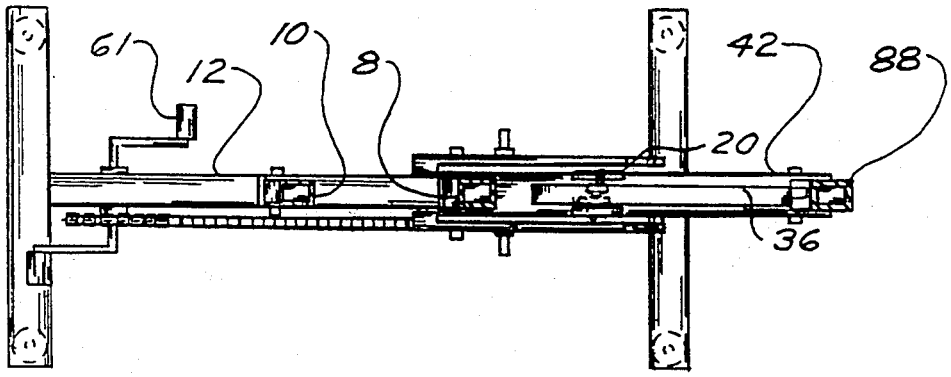
FIG. 3 is a plan view of the lower portion of the invention shown in FIG. 1, taken at plane 3—3.

A chain 32 connects gear 30 to a complementary gear 34 that is fixed to a rotatable flywheel 36. The flywheel is located within the arcuately-shaped frame portion 8 and is similar in size and shape to a bicycle wheel. The outer portions 38 of the flywheel's axle (also note FIG. 2) extend through a complementary slot 40 located in each of the vertical members 20. As shown, each end of the axle is secured to the associated member 20 by a fastener 41 that engages the member 20 proximate the slot. The slots allow the flywheel to be vertically adjusted by loosening the fastener and then sliding the axle portion of the flywheel in an upward or downward direction within the slot.

Located below flywheel 36 is a substantially horizontally-oriented member 42. The member is adjustably attached at each end to frame portion 8 by removable pins 44. The pins extend through end-located apertures 45 of member 42 and are selectively placed into one of the plurality of bores 46 located in frame portion 8.

Figure 4:
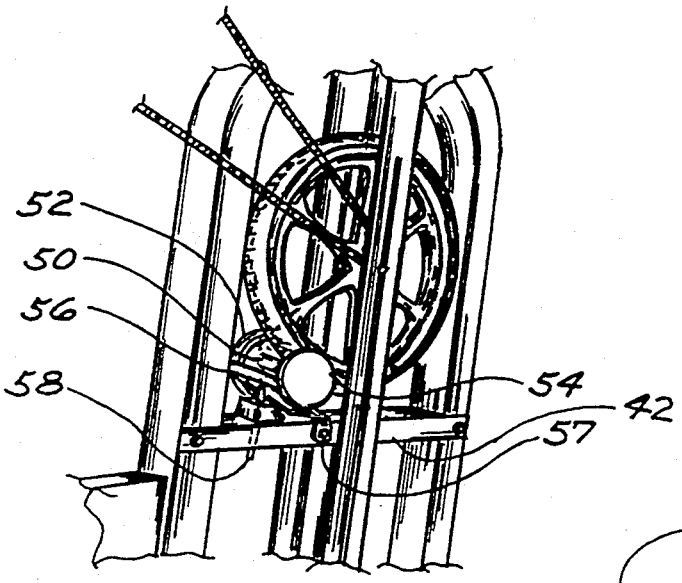
FIG. 4 is a detailed view of the upper resistance mechanism and flywheel.

A resistance mechanism 48 is mounted on member 42 and engages the outer surface of flywheel 36. A closer view of the resistance mechanism is provided in FIG. 4. The mechanism includes a roller 50 to which is attached an electrical generator 52 and a balance disk 54. The roller is rotatably mounted to a pivotable plate 56. The plate may be pivoted about its mounting pin 57 via a manually adjustable bolt 58 that is threadably engaged to member 42. By turning the bolt, a user can increase or decrease the contact force between the flywheel and the roller to thereby vary the degree of difficulty required to cause the rotation of the flywheel.

The lower rotatable assembly 24 is similar to the upper rotatable assembly 22 and includes a crankset 60 that has a pair of outwardly-extending pedals 61. The pedals are similar to those commonly employed on bicycles and exercycles.

Attached to crankset 60 and rotatable therewith is a gear 62. A chain 64 links gear 62 to a complementary gear 68 that is secured to a rotatable flywheel 70. A resistance mechanism 72 contacts the bottom surface of the flywheel and is identical to the resistance mechanism employed by the upper rotatable assembly. Adjustment of the resistance is made by appropriate turning of screw 73. Since flywheel 70 is attached to the vertical members 20 in a manner wherein it is not vertically-adjustable, the support member 74 for the resistance mechanism is not required to be vertically-adjustable. Therefore, member 74 is fixedly-attached to frame portion 8 at both ends.

Figure 5:
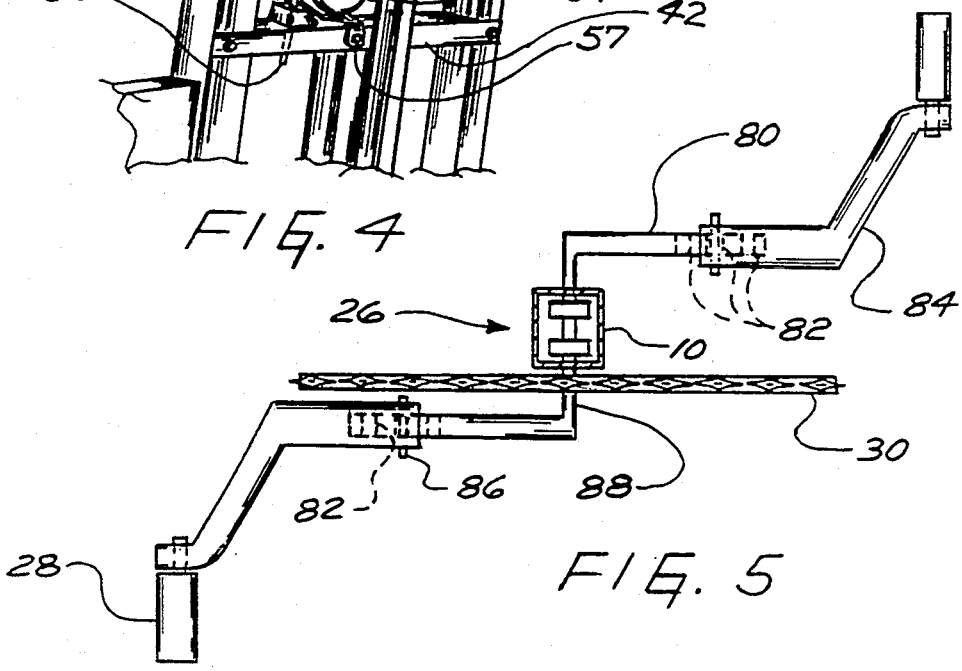
FIG. 5 is a detailed plan view of the upper crankset showing the optional adaptors for attaching the handles to the crankset.

FIG. 5 shows an alternative embodiment of an upper crankset 26'. The cranks 80 include a plurality of threaded apertures 82. In one method of use, a peg-like handle or handle member 28 may be engaged with any one of the apertures and thereby resemble the embodiment shown in FIG. 1. In the method of use shown in FIG. 5, a "V"-shaped adaptor 84 is employed. The adaptor is telescopically engaged to the associated crank and a threaded pin 86 allow a user to secure the adaptor to any one of the apertures 82

The adaptors 84 function to adjustably increase the distance between each handle 28 and the crankshaft 88 thereby adjusting the diameter of the circular path that each of the handles follows when the crankset is rotated. The adaptors also function to increase the outward separation between the two handles (i.e.- the separation distance between the two circular paths traveled by the handles). In this manner, the adaptors allow a user having broad shoulders to rotate the handles in planes that are in line with the ends of his or her shoulders. By effectively adjusting the length of the cranks through appropriate positioning of pins 86 in apertures 82, the machine is able to be adjusted to more comfortably fit the length of the user's arms. The adaptors therefore allow a user to adjust the path of travel of the handles to more comfortably fit his or her own body dimensions.

Figure 6:
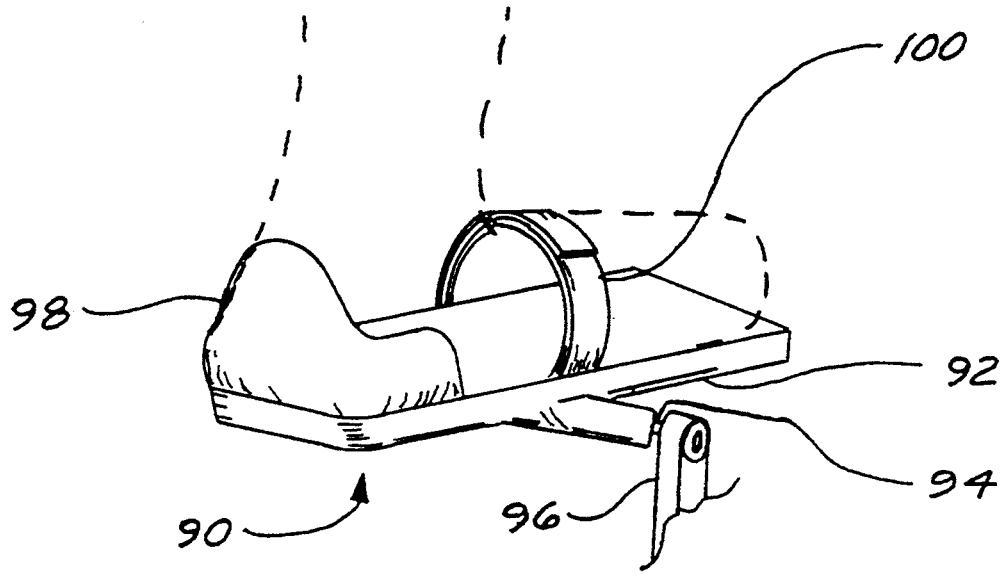
FIG. 6 is a detailed view of a modified pedal member with a bottom portion of a user's leg shown in phantom.

FIG. 6 provides a perspective view of a modified pedal 90 that is designed to increase the support provided by the lower crankset 60. A pair of the pedals 90 would replace the pedals 61 shown in FIG. 1.

Each pedal 90 includes an elongated base 92 that is rotatably secured to an axle 94. The axle is threadably engaged to one of the cranks 96 of crankset 60. The base of the pedal is designed to fit beneath the entire foot of the user. Located at the trailing end of the base is an upwardly-extending heel restraint or counter 98 adapted to receive the user's heel. A strap 100 is located near the midpoint of the pedal and is designed to releasably retain the user's foot on the pedal.

When the machine includes pedals 90, the user is provided with enhanced support compared to standard bicycle-type pedals. The long base and the added heel counter maximizes the contact area between the user's foot and the pedal thereby providing the user with a high degree of support and stability. In this manner, a user can comfortably stand on the machine without experiencing undue leg strain resulting from prolonged partial support of the feet.

To use the machine, a person initially checks the height of the upper rotatable assembly and if required, adjusts it so that crankset 26 is located just above his or her head as shown in FIG. 1. Height adjustment of the upper rotatable assembly 22 is accomplished by first loosening the fasteners 41 that secure the position of flywheel 36 on the vertical members 20. This allows the flywheel to be moved vertically in the slots 40. The user next adjusts the height of the upper crankset by removing pin 14 and then moving the upper section 10 of the front frame portion 6 until the crankset is in the proper position. As the crankset moves vertically, gravity or chain tension will cause a similar vertical adjustment in the position of flywheel 36. The pin is then placed through the appropriate aperture 16 to fix the position of frame portion 10 within frame portion 12. Member 42 is next moved within frame section 8 via pins 44 in apertures 45 and 46 until the resistance mechanism 48 properly engages the flywheel 36. As the last step in the height adjustment procedure, nuts 41 are tightened to secure the flywheel in place. The resistance mechanisms 48 or 72 are then adjusted by loosening or tightening bolts 58 and 73 respectively.

The user then stands on pedals 76 of the lower crankset and grasps handles 28 of the upper crankset. Next, the user either causes the upper flywheel 36 to rotate via handles 28, causes movement of the lower flywheel 70 by rotating the pedals or causes both flywheels to turn by rotating the handles and pedals simultaneously. It is entirely up to the user how rapidly to rotate either assembly and how much effort is to be required for the rotation of each assembly. In addition, the user can employ the optional handle adaptors 84 to improve the comfort of the device and/or to change the range of motion required to turn the upper crankset. The modified pedals shown in FIG. 6 can also be employed in lieu of the standard pedals if the user wanted to increase the support provided by the lower crankset.

It should be noted that the frame of the machine 1 is shown as being inclined at approximately a fifteen degree angle from true vertical. The inclination of the machine can be varied by adjusting the height of leveling feet 102 that are threadably engaged to the front and rear ends of base 4.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. An exercise machine adapted for use by a person who is in a standing position, said machine comprising:

a base;

a frame that extends upwardly from said base;

an adjustable length crankset support means attached to said base;

a first crankset rotatably secured to a bottom portion of said crankset support means;

first and second pedals that extend outwardly from said first crankset and are connected to a crankshaft of said crankset;

a second crankset rotatably secured to an upper portion of said crankset support means and located above the first crankset;

first and second handles that extend outwardly from said second crankset and are connected to a crankshaft of said second crankset;

a first flywheel rotatably attached to said frame, said flywheel being spaced from said first crankset and operatively connected to said first crankset by a connector means;

a second flywheel rotatably attached to said frame and by a first attachment means, said flywheel being spaced from said second crankset and operatively connected to said second crankset by a connector means;

said first attachment means having an adjustment means for allowing said second flywheel to be vertically adjustable on said frame;

a first adjustable resistance means operatively connected to the frame and capable of acting on the first flywheel to change the facility with which said flywheel may be rotated; and a second adjustable resistance means operatively connected to the frame, said second adjustable resistance means being capable of acting on the second flywheel to change the facility with which said flywheel may be rotated.

2. The machine of claim 1 wherein the first and second cranksets are spaced vertically apart from each other and wherein the crankset support means includes height adjustment means that functions to change the spacing between the first and second cranksets.

3. The machine of claim 2 wherein the crankset support means is in tubular form and has a longitudinal axis that is inclined relative to a vertical axis.

4. The machine of claim 2 wherein upper and lower portions of the crankset support means are telescopically engaged and releasably locked together by a locking means which in combination with the telescoping portions of the crankset support means forms the height adjustment means.

5. The machine of claim 2 wherein the frame includes two side members and wherein each of said side members has a slot that is adapted to receive an end portion of an axle of the second flywheel and wherein the end portions of the axle of the second flywheel may be moved in a substantially vertical direction within the slots of the side members.

6. The machine of claim 1 wherein the second adjustable resistance means is attached to the frame by an adjustable attachment means that allows the second adjustable resistance to be positioned in a plurality of vertically spaced locations on said frame.

7. The machine of claim 1 wherein the first and second handles are attached to a first end portion of a "V"-shaped adaptor and wherein a second end portion of the "V"-shaped adaptor is attached to the second crankset by an attaching means.

8. The machine of claim 7 wherein the attaching means that attaches each "V"-shaped adaptor to the second crankset includes length adjusting means that enables a user to adjust a distance dimension between the associated handle and the second crankset.

9. An exercise machine comprising:

a first rotatable assembly, said assembly having a crankset with outwardly extending pedals, a flywheel operatively connected to the crankset and a first adjustable resistance means operatively connected to the flywheel;

a second rotatable assembly, said assembly having a first axle supporting a crankset with outwardly extending handles, a second axle supporting a flywheel operatively connected to the crankset and a second adjustable resistance means operatively connected to the flywheel;

a frame means to which the first and second rotatable assemblies are attached and are spaced from each other and wherein said second rotatable assembly is located above said first rotatable assembly and is operatively independent from said first rotatable assembly; said second rotatable assembly comprising means for height adjusting said crankset and said flywheel; and wherein when the machine is to be used, a person would stand on the pedals of the first rotatable assembly.

10. The machine of claim 9 wherein each of the handles of the second rotatable assembly is attached to the crankset by an associated "V"-shaped adaptor that is secured to the crankset by an attaching means.

11. The machine of claim 10 wherein the attaching means that attaches the adaptors to the crankset includes two telescopically engaged members that allow a user to adjust a distance dimension between the handles and a crankshaft of the crankset.

12. The machine of claim 9 wherein each of the pedals of the first rotatable assembly has an elongated base that is at least six inches in length and is adapted to substantially underlie the entire length of a user's foot when a user's foot is located on one of the pedals.

13. The machine of claim 9 wherein the crankset of the first rotatable assembly has a central axis and wherein the crankset of the second rotatable assembly has a central axis and wherein the central axis of the crankset of the second rotatable assembly is located forwardly and above the axis of the crankset of the first rotatable assembly.

14. The machine of claim 9 wherein the frame means includes a telescopically adjustable front member that is inclined relative to a vertical axis and wherein the crankset of the first rotatable assembly and the crankset of the second rotatable assembly are both secured to the front member of the frame means.

15. The machine of claim 14 wherein the frame means includes a height adjustment means that enables a user to adjust the amount that the front member of the frame means is inclined relative to said vertical axis.

* * * * *